US010145516B2

(12) United States Patent
Thiel

(10) Patent No.: US 10,145,516 B2
(45) Date of Patent: Dec. 4, 2018

(54) LED LIGHT TUBE END CAP WITH SELF-DOCKING DRIVER COMM BOARD

(71) Applicant: LECCONNECT, LLC, Howell, MI (US)

(72) Inventor: Joseph A. Thiel, Traverse City, MI (US)

( * ) Notice: Subject to any disclaimer, the term of this patent is extended or adjusted under 35 U.S.C. 154(b) by 0 days.

(21) Appl. No.: 15/689,947

(22) Filed: Aug. 29, 2017

(65) Prior Publication Data

US 2018/0058637 A1 Mar. 1, 2018

Related U.S. Application Data

(60) Provisional application No. 62/381,111, filed on Aug. 30, 2016.

(51) Int. Cl.

| | |
|---|---|
| ***F21V 23/02*** | (2006.01) |
| ***F21S 4/00*** | (2016.01) |
| ***F21K 9/272*** | (2016.01) |
| ***F21K 9/278*** | (2016.01) |
| ***F21V 3/02*** | (2006.01) |
| ***F21V 23/00*** | (2015.01) |

(Continued)

(52) U.S. Cl.

CPC ..... *F21K 9/272* (2016.08); *F21K 9/278* (2016.08); *F21V 3/02* (2013.01); *F21V 17/16* (2013.01); *F21V 23/003* (2013.01); *F21V 23/006* (2013.01); *F21V 23/06* (2013.01); *F21Y 2103/10* (2016.08); *F21Y 2115/10* (2016.08)

(58) Field of Classification Search

CPC ..... F21V 23/003; F21V 23/006; F21V 23/06; F21V 3/02; F21V 19/008; F21V 19/0035; F21V 17/16; F21V 17/164; F21V 17/104; F21Y 2103/10; F21Y 2115/10

See application file for complete search history.

(56) References Cited

U.S. PATENT DOCUMENTS 7,938,562 B2 5/2011 Ivey et al.
7,946,729 B2 5/2011 Ivey et al.

(Continued)

FOREIGN PATENT DOCUMENTS

CN 204460096 U 7/2015

OTHER PUBLICATIONS

JYS, Bluetooth LED Board, product brochure, Nov. 23, 2012, 1 page, JYS, U.S.

(Continued)

*Primary Examiner* — Laura Gudorf
(74) *Attorney, Agent, or Firm* — Northern Michigan Patent Law, PLC

(57) ABSTRACT

An LED light tube assembly comprising an LED light tube with an LED array board in a tubular housing, and an end cap with a driver board removably secured to the end of the LED light tube. The driver board extends from a cap midpoint at a first level corresponding to an underside of the LED board in the tube, and the cap includes a connector tongue spaced from and parallel to the driver board at a second level corresponding to a portion of the sidewall of the tubular housing. The driver board further includes spring terminals that frictionally engage an upper surface of the LED board as the cap is assembled to the light tube, while remaining assembly and connection forces are borne by the cap and the tubular housing.

10 Claims, 8 Drawing Sheets

(51) Int. Cl.

| | |
|---|---|
| ***F21V 17/16*** | (2006.01) |
| ***F21V 23/06*** | (2006.01) |
| *F21Y 103/10* | (2016.01) |
| *F21Y 115/10* | (2016.01) |

(56) References Cited

U.S. PATENT DOCUMENTS

| | | | | |
|---|---|---|---|---|
| 8,214,084 | B2 | 7/2012 | Ivey et al. | |
| 8,398,258 | B1 | 3/2013 | Gerrish et al. | |
| 8,444,292 | B2 | 5/2013 | Ivey et al. | |
| 8,454,193 | B2 | 6/2013 | Simon et al. | |
| 8,596,813 | B2 | 12/2013 | Ivey | |
| 8,633,646 | B2 | 1/2014 | Molezion | |
| 8,981,646 | B2 | 3/2015 | Kim | |
| 2007/0024461 | A1 | 2/2007 | Pederson et al. | |
| 2008/0290814 | A1 | 11/2008 | Leong et al. | |
| 2010/0201239 | A1* | 8/2010 | Mostoller | F21S 8/031 313/1 |
| 2013/0230995 | A1 | 9/2013 | Ivey et al. | |
| 2014/0055043 | A1 | 2/2014 | Ivey et al. | |
| 2014/0253733 | A1 | 9/2014 | Norem et al. | |
| 2014/0268773 | A1 | 9/2014 | DeKeyser | |
| 2014/0375204 | A1 | 12/2014 | Dai et al. | |
| 2015/0008846 | A1 | 1/2015 | Chen et al. | |
| 2015/0043212 | A1 | 2/2015 | Coffey et al. | |
| 2015/0062889 | A1* | 3/2015 | Kika | F21S 8/031 362/223 |
| 2018/0112836 | A1* | 4/2018 | Rieder | F21K 9/272 |

OTHER PUBLICATIONS

Dialog Semiconductor, iW6401 Digital Smart Lighting LED Driver, product overview (online), May 27, 2016, 4 pages, http://www.dialog-semiconductor.com/products/lighting/ssl/iw6401, U.S.

* cited by examiner

LED LIGHT TUBE END CAP WITH SELF-DOCKING DRIVER COMM BOARD

RELATED APPLICATIONS/PRIORITY BENEFIT CLAIM

This application claims the benefit of U.S. Provisional Application No. 62/381,111, filed Aug. 30, 2016 by the same inventor (Thiel), the entirety of which provisional application is hereby incorporated by reference.

FIELD

The subject matter of the present application is in the field of end caps for LED lighting fixture tubes.

BACKGROUND

Large scale lighting systems for businesses, industrial operations, educational institutions, hospitals and similar have traditionally used fluorescent light fixtures with replaceable fluorescent light tubes. These fluorescent tubes are increasingly being replaced with LED (light emitting diode) light tubes having arrays of board-mounted LEDs with power supply or "driver" circuits for controlling LED operating parameters. In some cases it is desirable to have driver circuitry in a driver board separate from the LED board. Prior driver boards are commonly soldered or connected by wire-and-plug terminals between the end cap and the LED board, in order to simplify replacement and to make it easier to modify or add to the functionality of the basic LED lighting in the tube by swapping out one type of driver board for another.

In some prior LED tubes the driver board is built into or connected directly to the end cap, for example by being integrated with an LED array in the end cap itself (U.S. Pat. No. 7,946,729), or with slot-to-board or header connections between a driver-containing board and the end cap (Chinese patent grant CN 204460096 U; Published App. No. US2013/0230995 A1 to Ivey et al).

It is also known to provide circuit boards in light tubes with wireless communication chips such as Bluetooth low energy (BLE) sensor modules, in order to enable building-wide wireless communication and/or sensor networks useful for signal tracking. An example of such an LED board is described in U.S. Pat. No. 8,214,084 to Ivey et al. Another example is shown in Published App. No. US2014/0375204 A1, with a communication circuit board in the end cap connected directly to a driver board.

Prior LED light tube driver and end cap arrangements are believed to be lacking in simplicity, strength, ease of replacement, and flexibility with respect to replacing malfunctioning driver boards or retrofitting existing LED light tubes for different communication and networking capabilities.

BRIEF SUMMARY

The present invention is an improved structure for replaceably assembling a separate LED driver and/or wireless communication board (hereafter driver board or driver comm board) to an LED light tube of the type used in large scale tube-lighting fixture environments.

In a first aspect, the inventive structure comprises an LED light tube having an LED board mounted in a tubular housing with a sidewall and a translucent light-emitting cover, a removable end cap with external electrical connector terminals (e.g., pins), and a driver board separate from the LED board. The driver board is integrated with the end cap for a strong, easily assembled snap-connection to the LED board and tube. The snap-connection of the driver board to the tube via the end cap makes a simultaneous electrical and mechanical connection providing a multi-level structural bridge between end cap, driver board, and LED array.

The end cap comprises a driver board extending axially from a cap midpoint at a first level corresponding to an underside of the LED board; and, a connector tongue extending from the cap sidewall, generally parallel to the driver board at a second level corresponding to the light tube sidewall opposite the translucent cover. An upper, outer (cap-side) end surface of the driver board includes spring-biased power supply terminals that mechanically and electrically engage the upper surface of an outer end of the LED board. The connector tongue includes a detent and guide cooperating with a slot and detent aperture on the light tube sidewall to align the driver and LED boards as the cap is applied, to secure the end cap on the tube simultaneously with the terminal connection between the driver and LED boards, and to resist torsion of the end cap on the tube once assembled.

When the end cap is fully assembled to the LED light tube, the driver board extends underneath and generally parallel to the LED board, with the outer end of the driver board suspended in free fashion. In a further form, at least some of the circuit and/or communication components of the driver board are located on its underside, facing away from the underside of the LED board. In still a further form, the cap includes a window aligned with the connector tongue below the driver board for RF and/or light transmission, and the driver board includes an RF or similar wireless communication module and/or a function indicator light operatively aligned with the window.

These and other features and advantages of the invention will become apparent from the detailed description below, in light of the accompanying drawings. Terms of orientation such as parallel, perpendicular, and the like should be understood as meaning generally so, rather than exact, unless otherwise specified.

DETAILED DESCRIPTION

Figure 1:
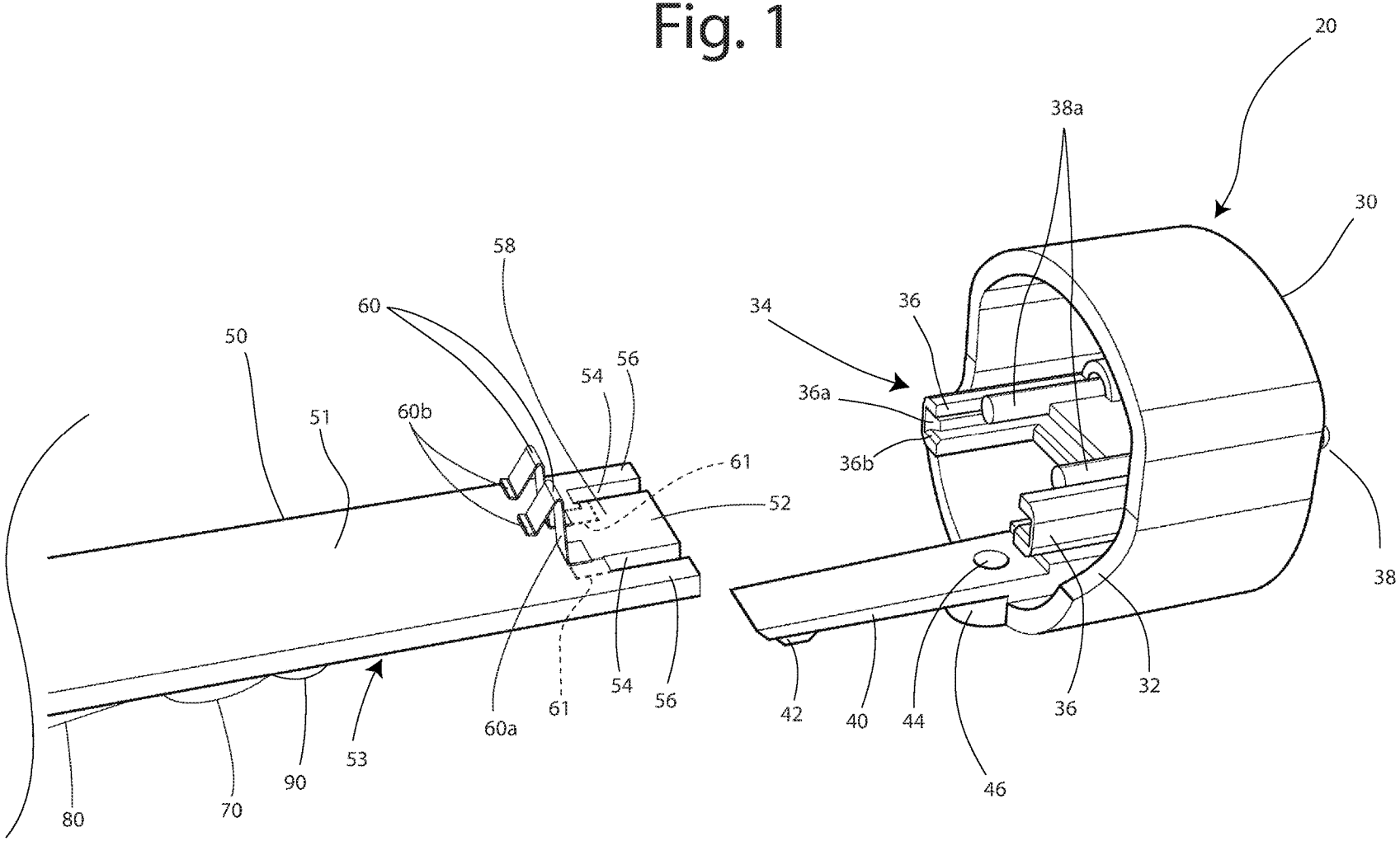
FIG. 1 is an upper side perspective view of an exemplary end cap according to the invention, with the driver board portion shown exploded from the cap.
Figure 2:
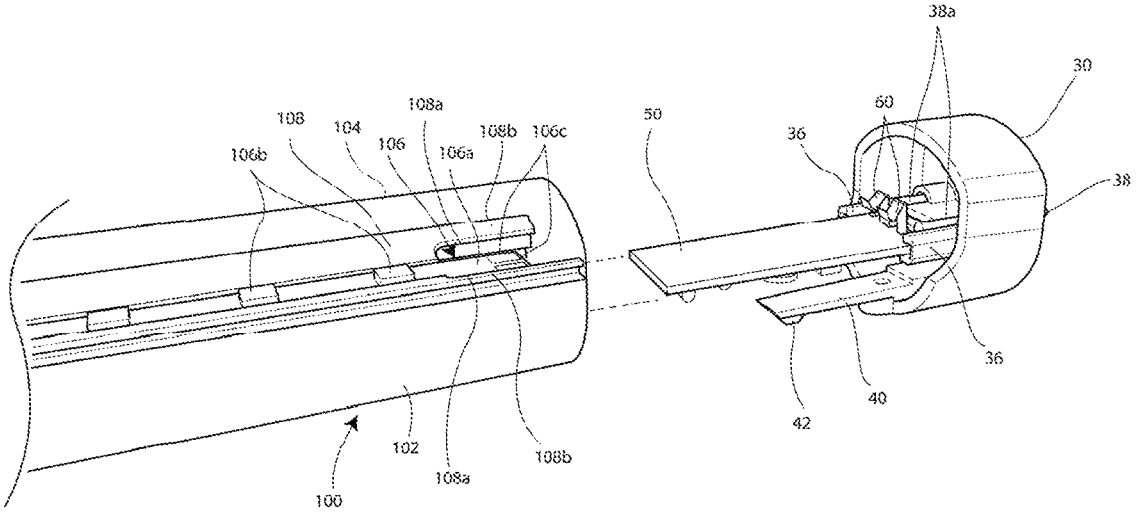
FIG. 2 is similar to FIG. 1, showing the end cap fully assembled, the assembled cap aligned for assembly to an LED light tube.
Figure 3:
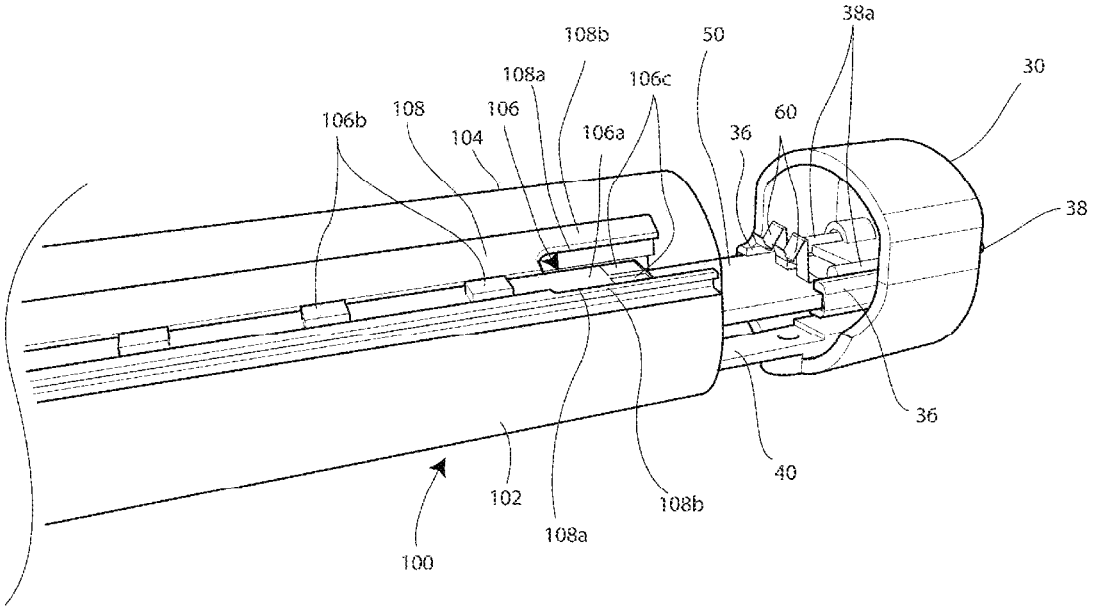
FIG. 3 is similar to FIG. 2, showing the end cap partially assembled to the light tube.

Referring first to FIG. 1, an end cap assembly 20 is shown in exemplary form in order to teach how to make and use the claimed invention. End cap assembly 20 comprises an end cap 30 and a driver board 50. End cap 30 may be made for example from a durable molded plastic, with a sidewall 32 defining an interior shaped to mate with the open end of an LED light tube (FIG. 2). A midpoint driver board docking structure 34 is formed on the cap's interior, with "midpoint" meaning an intermediate location spaced between the upper and lower sides of cap 30, including but not limited to the center of the cap. In the illustrated example of a cap 30 with a circular sidewall 32, "upper" and "lower" sides will be used as terms of relative orientation based on the orientation of the drawing, and are not limiting as to the installed position of the light tube. It will be understood that although a tubular light tube with a circular sidewall end cap is shown, other tubular cross-sectional shapes with matching end cap configurations are possible.

Cap 30 also includes a pair of electrical connector terminals 38 protruding from its outer end. Terminals 38 may be of any known type, for example metal pins commonly used for tube lighting fixture elements.

Driver board docking structure 34 in the illustrated example comprises a pair of opposed axial rails 36 on the interior of sidewall 32, aligned in parallel with and bracketing the inner ends 38*a* of electrical connector terminals 38. Docking structure 34 is preferably an integral molded feature of the cap on sidewall 32, or projecting from the interior side of the cap outer end wall 31. Docking structure 34 may alternatively comprise separately formed structure of the same or different material attached to the cap interior. Illustrated rails 36 define generally C-shaped grooves 36*a* with raised, angled ramps 36*b* at the entrances to the grooves.

Cap 30 also includes a connector tongue 40 extending axially from the lower side of sidewall 32, and therefore spaced radially from and generally parallel to driver board docking structure 34. Connector tongue 40 includes a lower side detent tab 42 projecting downwardly from its inner free end and an upper side aperture or light and/or RF transmissive window 44 at its outer base end near where it joins cap sidewall 32. Connector tongue 40 also includes a lower side guide 46 at its outer or base end, the guide 46 shaped to slidingly mate with a corresponding female alignment feature on an LED light tube (FIG. 2).

Illustrated cap 30 also includes an elongated RF and/or light transmissive window 48 on its lower side (FIG. 5) aligned with and spaced outwardly from connector tongue 40, which also happens to align at least a portion of the window with the underside of driver board 50 when the driver board is assembled to cap 30. More specifically, the forward or inner end of window 48 is aligned with base guide feature 46 and aperture 44 in tongue 40 to efficiently transmit light and/or wireless signals from components on board 50 through the cap sidewall. While cap 30 can be formed from different materials such as plastic or metal, an easily molded, heat-resistant polymer is preferred except where metal is needed for electrical contact or additional strength. Windows 44 and 48 may be open apertures, or may be formed from suitably light transmissive and/or wireless signal transmissive material. In one embodiment the window 44 may be a light tube to light window 48 showing status from an interior status-indicating LED.

Still referring to FIG. 1, exemplary driver board 50 has an outer end 52 configured to be removably secured in cap 30 by mating with driver board docking structure 34. Outer end 52 includes terminal-receiving slots 54 defining outer fingers 56 and center tab 58, shaped to slide into and frictionally mate with the rails 36 and to receive at least some portion of the pin terminal ends 38*a* of the cap-side docking structure 34. Pin ends 38*a* are injection molded into the end cap 30 and soldered to the board in slots 54. Inner ends of fingers 56 or underside portions of driver board 50 adjacent the fingers may include recesses or protrusions to engage and axially lock onto rail entrance ramp portions 36*b* for a more secure fit, and terminal ends 38*a* are preferably mechanically soldered to the board 50 in slots 54 in electrical connection with terminals 60 via internal or surface conductors schematically illustrated at 61 extending from terminals 60 to slots 54, for strength. Any known soldering technique can be used, and it is possible to re-flow solder any or all components that need or that can benefit from a solder connection between metal contacts in one step once the driver board 50 is first mechanically assembled to cap 30.

Spring stop terminals 60 protrude from the driver board's upper surface 51, establishing spaced parallel electrical connection points in communication via internal or external conductor paths on the driver board with the LED driver and communication circuitry located elsewhere on the board.

Driver board 50 may utilize conventional circuit board materials and construction, for example of the MPCB type, and includes known LED driver or power control circuitry 70 such as one or more driver chips. Driver board 50 may also include one or more types of wireless communication circuitry or modules or wireless sensors 80, for example Bluetooth® type low energy (BLE) sensor modules and/or high frequency RF modules (e.g., 915 MHz standard or similar), and may further include a button battery, rechargeable battery, or supercapacitor backup power source 90 for power interruptions or when power to the system is off. This battery or supercapacitor may also illuminate the circuit board indicator lights for specific purposes programmed by an outside source. In the illustrated example, at least some and preferably all of the circuitry 70, 80 is located on the lower face 53 of the driver board, facing connector tongue 40 and the lower side of cap 30.

Illustrated driver board 50 includes an LED status indicator light 95 on its lower side 53. Status light 95 is positioned to be vertically or at least visually or optically aligned with aperture 44 and window 48. Window 48 may also be positioned or sized to provide optimal RF or other wireless transmission from wireless communication features 80 on driver board 50.

Figure 5:
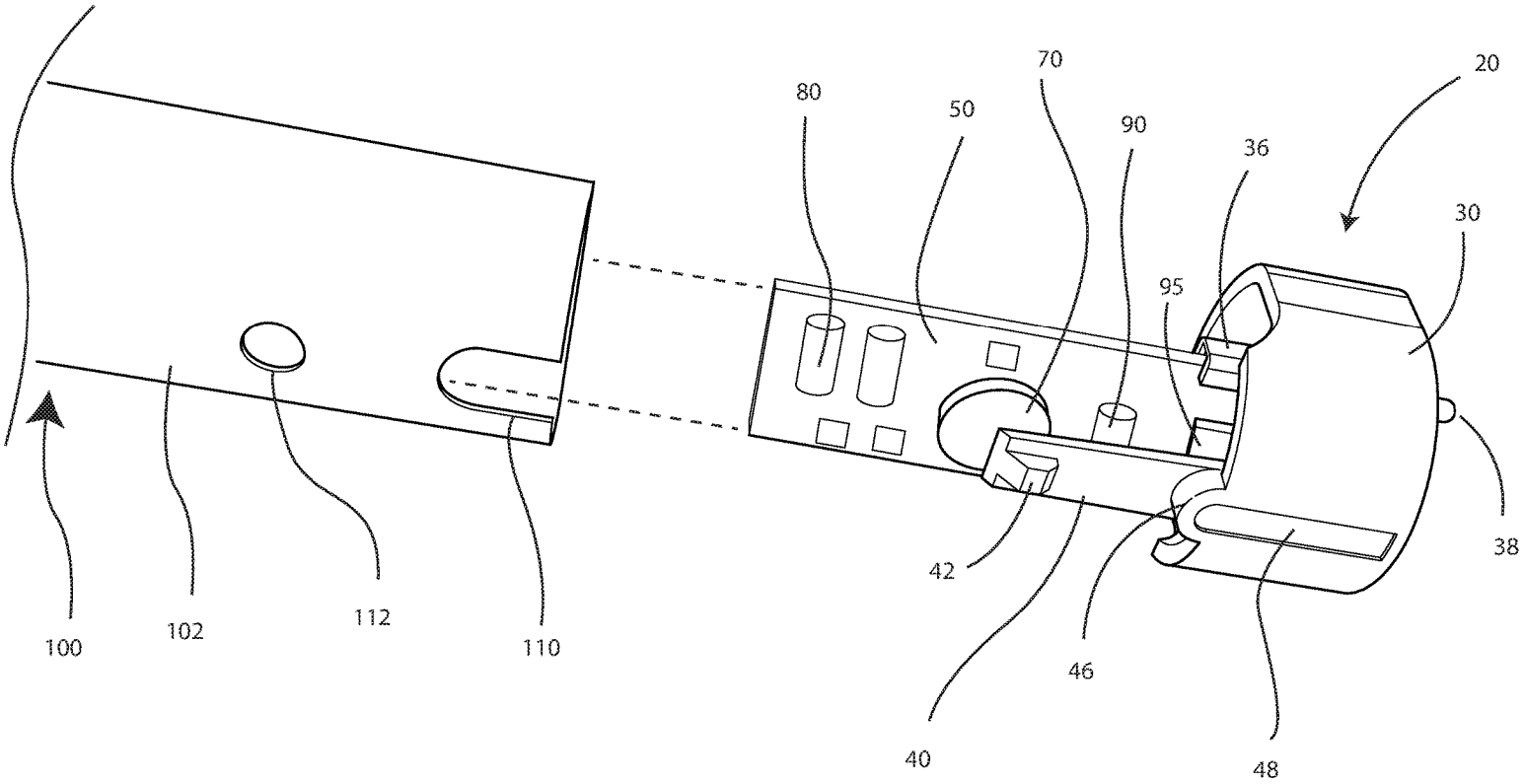
FIG. 5 is a lower side perspective view of the end cap and light tube of FIG. 1, showing the end cap aligned for assembly to the LED light tube.
Figure 6:
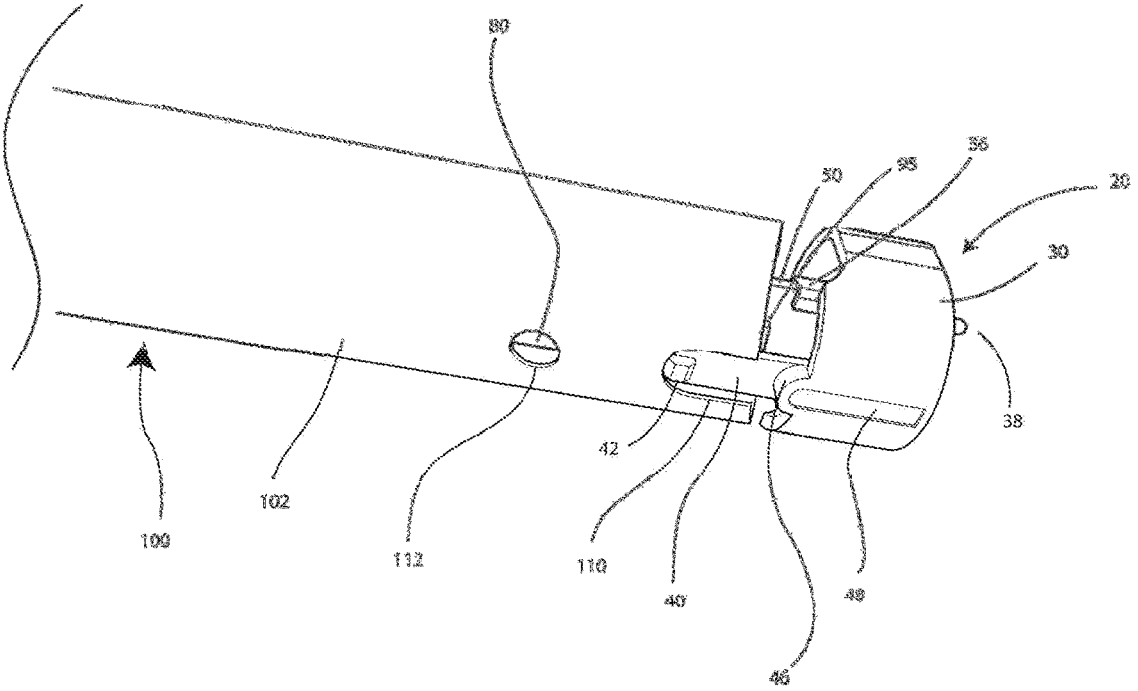
FIG. 6 is similar to FIG. 5, showing the end cap partially assembled to the light tube.

Referring now to FIGS. 2 and 5, the assembled cap-and-driver board assembly 30, 50 is shown being aligned for fitting onto the open end of a mating LED light tube 100. Light tube 100 includes a lower housing sidewall 102, for example an opaque material (although a translucent material is possible), and an upper translucent or transparent (hereafter translucent) cover 104, both made of known materials generally used for light tubes. The cover portion of the light tube may be integral with or separable from the sidewall portion 102. An LED board 106 of conventional type is mounted lengthwise in tube 100, comprising for example MPCB 106*a*, an array of electrically connected LED lights or emitters 106*b* facing cover 104 to emit light therethrough, and upper surface driver board contacts 106*c* in electrical contact with LED lights 106*b* through suitable connections on or in board 106*a*.

Figure 4:
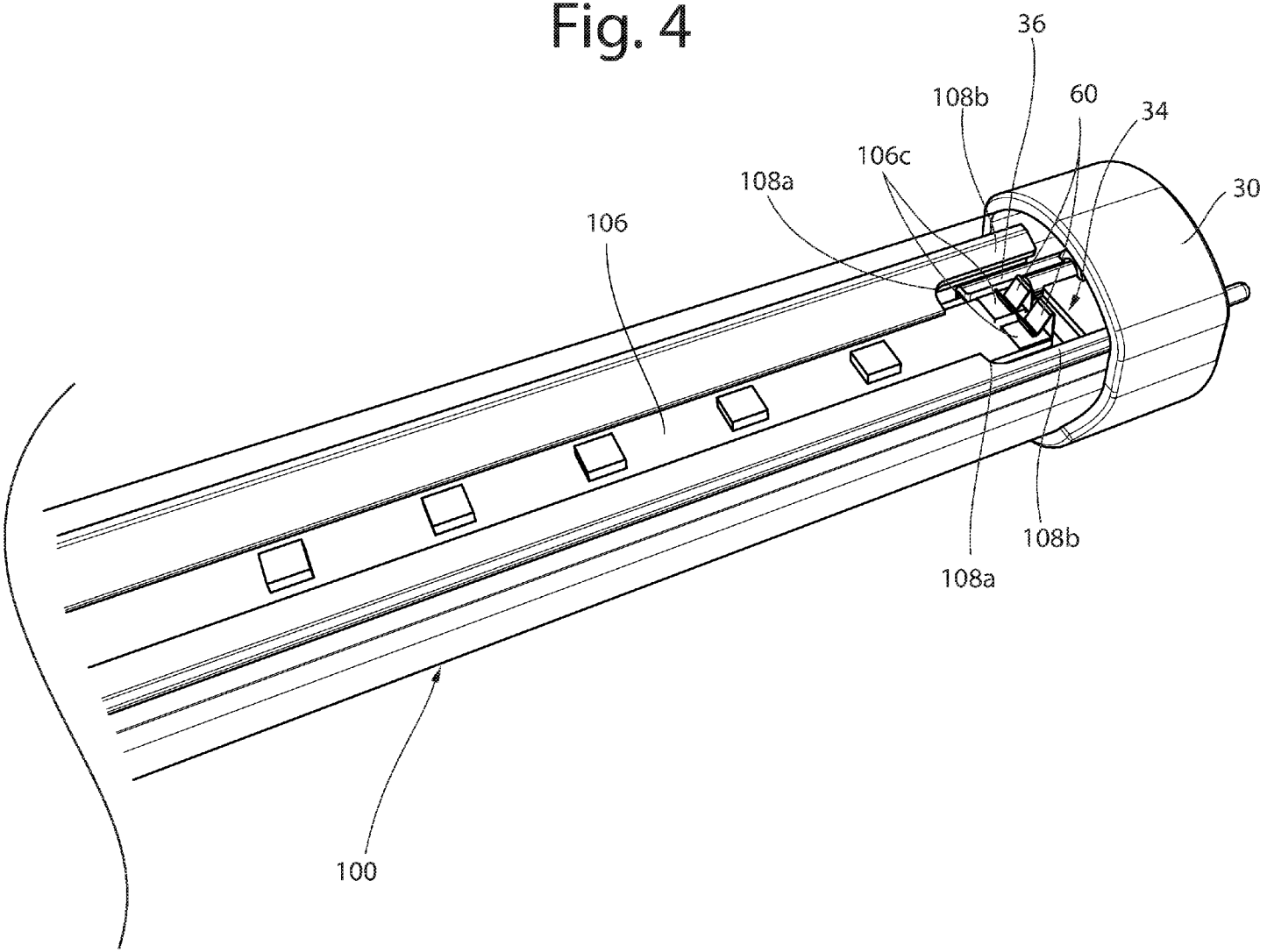
FIG. 4 is similar to FIG. 3, showing the end cap fully assembled to the light tube from an upper perspective.

Light tube 100 additionally includes a pair of side rails 108 running lengthwise generally along the junction between the lower housing sidewall 102 and the upper translucent cover 104, molded for example into the material of housing sidewall 102. The outer ends 108*b* of side rails 108 are relieved at 108*a* to define a widened docking cutout area for the mating terminal portions 60 and 106*c* of driver board 50 and LED board 106. Docking terminal cutout 108*a* also allows visual confirmation of the contact between terminals 60 and 106*c* when the cap is assembled to the light tube. As best shown in FIG. 4, docking rails 36 on cap 30 slidingly mate with channels formed by the outer ends 108*b* of side rails 108 in the relieved area 108*a*.

Cap-to-tube assembly begins as shown in FIGS. 2-3 and 5-6, by sliding the inner free end 50*a* of driver board 50 axially underneath LED board 106 in the light tube. If the upper surface 51 of driver board 50 and/or the lower surface of LED board 106 is free of protruding circuit and/or communication components, as shown in the illustrated example, the risk of damage to the respective boards 50, 106 is reduced. Connector tongue 40 is engaged with the inner surface of the lower housing sidewall 102. Lower detent tab 42 on tongue 40 first is aligned with alignment slot 110 on the lower housing sidewall 102 of the light tube as it proceeds into the tube, and may then slides on the interior surface of housing sidewall 102 to guide it into engagement with detent locking aperture 112 spaced inwardly from slot 110. A groove or channel (not shown) may optionally be provided on the inner surface of housing sidewall 102 in alignment with and between slot 110 and aperture 112 to help guide tab 42 into the aperture, if desired. Guide base 46 at the outer or base end of connector tongue 40 will enter slot 110 partway through the assembly process, further maintaining rotational alignment of the cap and tube until they are fully assembled.

Figure 7:
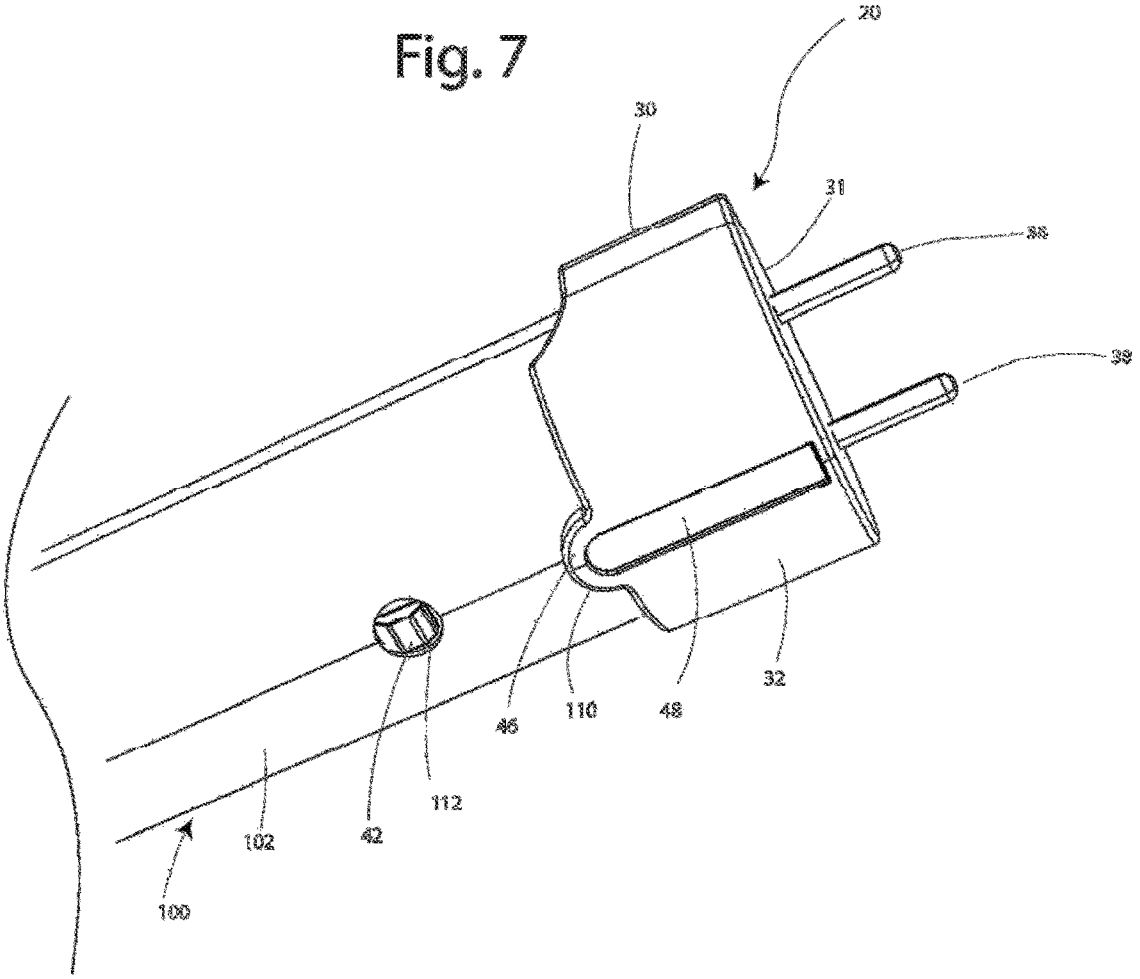
FIG. 7 is similar to FIG. 6, showing the end cap fully assembled to the light tube.

Assembly continues and is finalized as shown in FIGS. 4 and 7, where detent tab 42 on the connector tongue 40 engages detent aperture 112, and the inner end of guide 46 abuts the inner, matingly-shaped end of slot 110. At the same time, the free ends 60*b* of stop terminals 60 on the upper side of driver board 50 frictionally engage terminal contacts 106*c* on the upper side of the LED board 106, with upright portions 106*a* of the terminals remaining spaced from the outer end of LED board 106 so that the stop point is determined by the mechanical connection between connector tongue 40 and guide base 46 and the mating features 112, 110 on the lower inner surface of tube 100.

Figure 8:
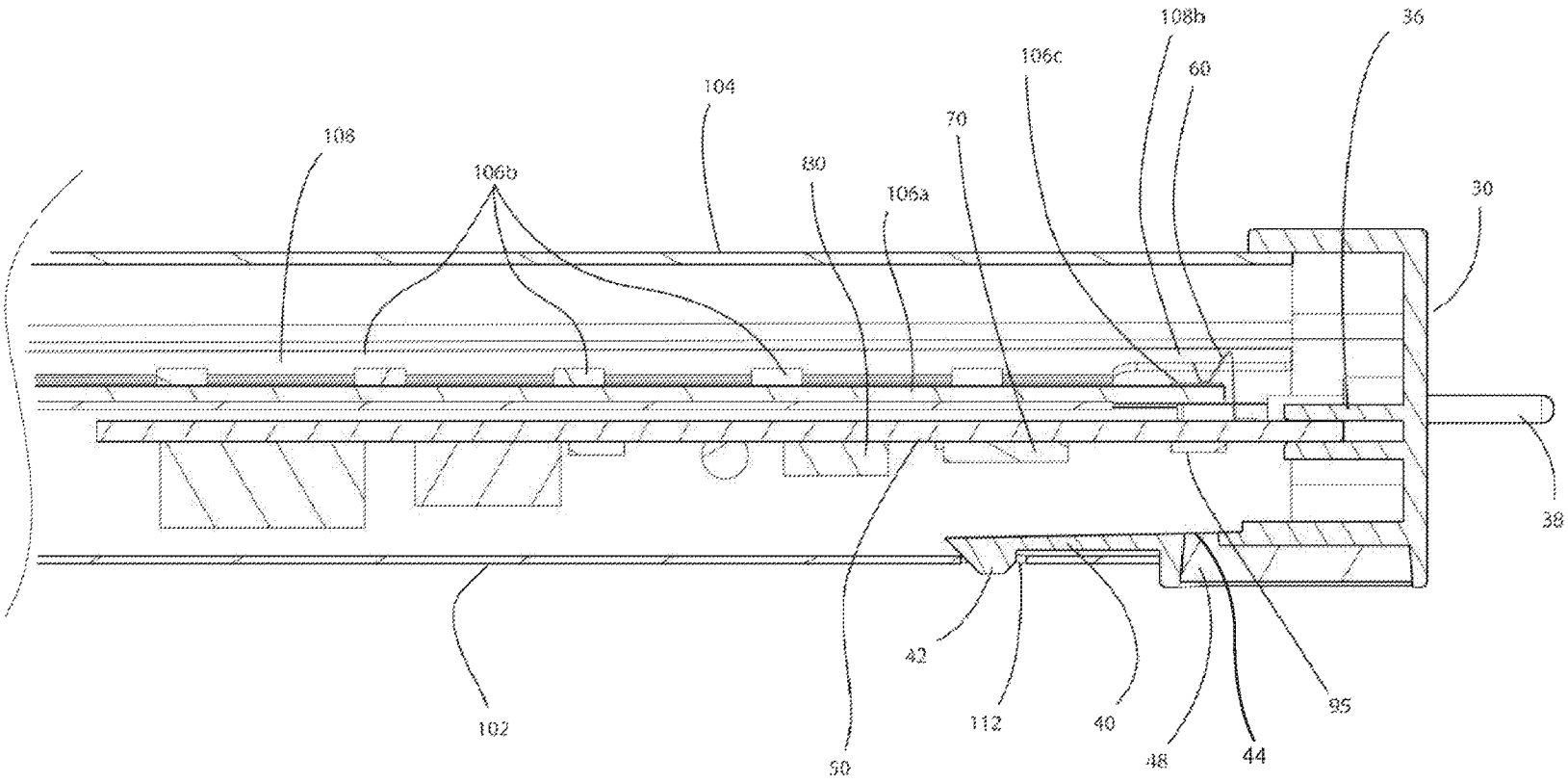
FIG. 8 is a side elevation view, partially sectioned, showing the end cap fully assembled to the light tube.

Referring now to FIG. 8, the assembled cap 30 and LED light tube 100 form a structurally strong multi-level mechanical connection, wherein the inner end 55 of the driver board 50 is suspended in free fashion below LED board 106, with the upper surface 51 of the driver board preferably spaced from the lower surface of the LED board 106, and the driver board is only subject to the sliding frictional forces between the ends of spring terminals 60 and the electrical contacts 106*c* on the upper face 106*a* and outer end of LED board 106. All other cap-to-tube connection forces are borne by the cap and light tube housings 30, 102 and their respective mechanical connection structures. When cap 30 needs to be removed for maintenance or replacement of the driver board 50, pushing on connector tongue detent tab 42 through aperture 112 in the lower tubular housing sidewall 102 unlocks cap 30, which can then be pulled free from the LED light tube by simply overcoming the frictional force of the driver board terminals 60 on the upper surface of LED board 106, without placing any additional stress on the driver board itself.

Likewise, once cap 30 is removed from light tube 100, driver board 50 can simply be pulled free from the docking structure 34 on cap 30 by overcoming the friction between docking rails 36 and the sides or fingers 56 of the driver board, and breaking any solder connection that may have been applied between terminal pin ends 38*a* and the driver board 50.

It will finally be understood that the disclosed embodiments represent presently preferred examples of how to make and use the invention, but are intended to enable rather than limit the invention. Variations and modifications of the illustrated examples in the foregoing written specification and drawings may be possible without departing from the scope of the invention. It should further be understood that to the extent the term "invention" is used in the written specification, it is not to be construed as a limiting term as to number of claimed or disclosed inventions or discoveries or the scope of any such invention or discovery, but as a term which has long been conveniently and widely used to describe new and useful improvements in science and the useful arts. The scope of the invention supported by the above disclosure should accordingly be construed within the scope of what it teaches and suggests to those skilled in the art, and within the scope of any claims that the above disclosure supports in this application or in any other application claiming priority to this application.

The invention claimed is:

1. An LED light tube assembly comprising an LED light tube comprising an LED board mounted in a tubular housing including a translucent cover and a sidewall portion opposite the translucent cover, and a removable end cap assembly with external electrical connector terminals, wherein:

the end cap assembly comprises an end cap having a sidewall, and a driver board extending axially from the end cap at a first midpoint level corresponding to an underside of the LED board;

a connector tongue extending axially from the cap sidewall generally parallel to and spaced radially from the driver board at a second level corresponding to the sidewall portion of the tubular housing, the connector tongue configured to mate with an outer end portion of the sidewall portion of the tubular housing to axially and rotationally secure the cap assembly to the LED light tube;

spring-biased power supply terminals on an upper, outer end surface of the driver board configured to engage an upper surface of an outer end of the LED board when axially assembled thereto; wherein, when the end cap is in an assembled condition on the LED light tube, the driver board extends underneath and generally parallel to the LED board, with an inner end of the driver board suspended in free fashion in the LED light tube beneath the LED board.

2. The LED light tube assembly of claim 1, wherein the connector tongue includes a detent and guide cooperating with a detent aperture and slot, respectively, on the tubular housing sidewall to align the driver and LED boards as the cap is applied, and to secure the end cap on the tube simultaneously with an engagement of the spring-biased power supply terminals with the upper, outer end surface of the LED board.

3. The LED light tube assembly of claim 1, wherein the driver board includes a status indicator light and/or a wireless communication component located on an underside of the driver board, facing away from the underside of the LED board, and the cap includes a window operatively aligned with the status indicator light and/or wireless communication component.

4. The LED light tube assembly of claim 1, wherein an upper surface of at least the inner end of the driver board is spaced from the lower surface of the LED board in the assembled condition.

5. The LED light tube assembly of claim 4, wherein an entirety of the upper surface of the driver board is spaced from the lower surface of the LED board in the assembled condition.

6. The LED light tube assembly of claim 1, wherein the driver board extends axially from the end cap farther than the connector tongue.

7. The LED light tube assembly of claim 1, wherein the end cap includes a docking structure for an outer end of the driver board, and the LED light tube includes a docking cutout area configured to mate with a portion of the end cap docking structure in the assembled condition, and further wherein the docking cutout area provides a view of an engagement of the spring-biased power supply terminals with the upper, outer end surface of the LED board through the translucent cover in the assembled condition.

8. The LED light tube assembly of claim 1, wherein the driver board and the connector tongue are located between the LED board and the light tube sidewall portion in the assembled condition.

9. The LED light tube assembly of claim 1, wherein at least one of the upper surface of the driver board and the lower surface of the LED board is free of protruding circuit and/or communication components.

10. The LED light tube assembly of claim 1, wherein sliding frictional engagement of free ends of the spring-biased power supply terminals on the driver board with contacts on the upper surface of the outer end of the LED board when axially assembled thereto is the only contact between the driver board and the LED board in the assembled condition.

* * * * *